US007913508B2

(12) United States Patent
Pu et al.

(10) Patent No.: US 7,913,508 B2
(45) Date of Patent: Mar. 29, 2011

(54) COOLING DEVICE FOR INTERIOR AND EXTERIOR SURFACES OF A MUD PUMP LINER

(75) Inventors: Rongchun Pu, Baoji (CN); Jianxu Hao, Baoji (CN); Hongqian Luo, Baoji (CN); Huiling Zu, Baoji (CN)

(73) Assignee: BAOJI Oilfield Machinery Co. Ltd. (CN)

( * ) Notice: Subject to any disclaimer, the term of this patent is extended or adjusted under 35 U.S.C. 154(b) by 668 days.

(21) Appl. No.: 11/966,277

(22) Filed: Dec. 28, 2007

(65) Prior Publication Data

US 2009/0032613 A1 Feb. 5, 2009

(30) Foreign Application Priority Data

Aug. 3, 2007 (CN) ..... 2007 1 0018524

(51) Int. Cl.
*F28D 5/00* (2006.01)

(52) U.S. Cl. ..... 62/310; 417/313; 417/572

(58) Field of Classification Search ..... 62/310; 417/415, 454

See application file for complete search history.

(56) References Cited

U.S. PATENT DOCUMENTS

| | | | | |
|---|---|---|---|---|
| 2,778,315 | A * | 1/1957 | Crookston et al. | 417/386 |
| 4,141,224 | A * | 2/1979 | Alger et al. | 62/50.1 |
| 6,895,905 | B2 * | 5/2005 | Bontaz et al. | 123/41.35 |
| 2006/0140778 | A1 * | 6/2006 | Warren | 417/53 |

FOREIGN PATENT DOCUMENTS

| | | | |
|---|---|---|---|
| CN | 99257860.4 | | 11/2000 |
| CN | 01252698.3 | | 1/2003 |
| CN | 20060078851.9 | | 5/2007 |
| FR | 2745329 | A1 * | 8/1997 |
| GB | 2419643 | A * | 5/2006 |
| GB | 2431217 | A * | 4/2007 |

OTHER PUBLICATIONS

Drawing of the Triplex Mud Pump, "How To Treat Your Type 'P' Triplex Mud Pump," National-Oilwell Company bulletin 209, p. 11 (2002).

Drawing of the FB-1300 & FB1600 fluid end, Emsco Operational Maintenance Manual, Bulletin No. FS-201, Drawing No. 6316-0375-00, p. PF-3-10.

* cited by examiner

*Primary Examiner* — Frantz F Jules
*Assistant Examiner* — Lukas Baldridge
(74) *Attorney, Agent, or Firm* — Ballard Spahr LLP

(57) ABSTRACT

A cooling device for interior and exterior surfaces of a mud pump liner, in which one end of the suction tube 3 is connected to the water tank 2, with the other end of the suction tube 3 connecting to the intake port of the spray pump 4, and an end of the discharge pipe 5 is connected to the outlet port of the spray pump, with another end thereof connecting to the interior cooling nozzle 1; and said another end of the discharge pipe 5 is also connected with a exterior cooling nozzle 6, the spray port of the interior cooling nozzle 1 is placed inside the liner 7, and the spray hole of the exterior cooling nozzle 6 is placed outside the liner 7. The present invention additionally performs spraying against the outer surface of the liner and cooling it so as to sufficiently cool the liner/piston. In this way, the working temperature of the liner/piston is decreased and the service life thereof is extended. Experiments show that the working temperature of the liner/piston is decreased by at least 16° C., and service life thereof is at least doubled.

2 Claims, 2 Drawing Sheets

COOLING DEVICE FOR INTERIOR AND EXTERIOR SURFACES OF A MUD PUMP LINER

CROSS-REFERENCE TO RELATED APPLICATIONS

This application claims the benefit of Chinese Patent Application No. 200710018524.3, filed Aug. 3, 2007, which is hereby incorporated herein by reference in its entirety.

FIELD OF THE INVENTION

The present invention relates to a cooling device for interior and exterior surfaces of a mud pump liner.

BACKGROUND OF THE INVENTION

In the prior art, the liner/piston or liner/plunger of a mud pump employs medium water to spray the interior bore surface of the liner so as to wash and cool the liner/piston or liner/plunger. However, those approaches cannot effectively lower the working temperature of the liner/piston or liner/plunger, and thus the service life of the liner/piston or liner/plunger is relatively short.

Documents relating to the above-mentioned prior art are, for example, CN Patent Application No. 200620078851.9, and CN Utility Patents No. ZL01252698.3 and ZL99257860.4.

SUMMARY OF THE INVENTION

One object of the present invention is to provide a cooling device for interior and exterior surfaces of a mud pump liner with additional spray cooling device for the exterior surface of the liner/piston or liner/plunger of a mud pump to achieve sufficient cooling. In this way, the working temperature of the liner/piston or liner/plunger is further decreased, and the service life of the liner/piston or liner/plunger is significantly extended.

To achieve the above object of the invention, according to the first aspect of the invention, a cooling device for interior and exterior surfaces of a mud pump liner is provided, which comprises an interior cooling nozzle, a water tank, a suction tube, a spray pump, and a discharge pipe, wherein one end of the suction tube is connected to the water tank, with the other end of the suction tube connecting to the intake port of the spray pump, and an end of the discharge pipe is connected to the outlet port of the spray pump, with another end thereof connecting to the interior cooling nozzle, the spray port of which is arranged inside the liner, and connecting to an exterior cooling nozzle, the spray port of which is arranged outside the liner.

Preferably, said spray port of the exterior cooling nozzle is placed above the liner.

It is favorable that said another end of the discharge pipe is connected to the interior cooling nozzle and the exterior cooling nozzle via a three-way pipe, respectively, and a valve 12 is serially connected between the exterior cooling nozzle and the three-way pipe.

To achieve the above object of the invention, according to the second aspect of the invention, a cooling device for interior and exterior surfaces of a mud pump liner is provided, which comprises an interior cooling nozzle, a water tank, a suction tube, a spray pump and a discharge pipe, wherein one end of the suction tube is connected to the water tank, with the other end of the suction tube connecting to the intake port of the spray pump, and an end of the discharge pipe is connected to the outlet port of the spray pump, with another end of the discharge pipe connecting to the spray pipe and an exterior cooling nozzle, and a spray port of the exterior cooling nozzle is placed outside the liner, the spray pipe is connected to the inlet for cooling liquid of the liner, the outlet for cooling liquid of the liner is connected to the plunger-cooling nozzle, and the spray port of the plunger-cooling nozzle is placed outside the plunger.

Preferably said spray port of the plunger-cooling nozzle is placed above the plunger, and said spray port of the exterior cooling nozzle is placed above the liner.

It is favorable that the inlet for cooling liquid of the liner is located at the lower portion of the outer wall of the liner, and the outlet for cooling liquid of the liner is located at the upper portion of the outer wall of the liner.

It is more preferable that said another end of the discharge pipe is connected to a spray pipe and the exterior cooling nozzle via a three-way pipe respectively, and a valve is serially connected between the exterior cooling nozzle and the three-way pipe.

In comparison with the prior arts, the advantages and effects of the present invention are as follows.

1. The present invention additionally performs spraying against the outer surface of the liner and sufficient cooling for the liner/piston. In this way, the working temperature of the liner/piston is decreased and the service life thereof is extended. Experiments show that the working temperature of the liner/piston is reduced by at least 16° C., and service life thereof is at least doubled.

2. The present invention additionally performs spraying against the outer surfaces of the liner and the plunger and sufficient cooling for the liner/plunger. In this way, the working temperature of the liner/plunger is reduced and the service life thereof is extended. Experiments show that the working temperature of the liner/plunger is reduced by at least 16° C., and the service life thereof is at least doubled.

DETAILED DESCRIPTION OF THE INVENTION

Detailed description of the first embodiment is given below with reference to FIG. 1.

Figure 1:
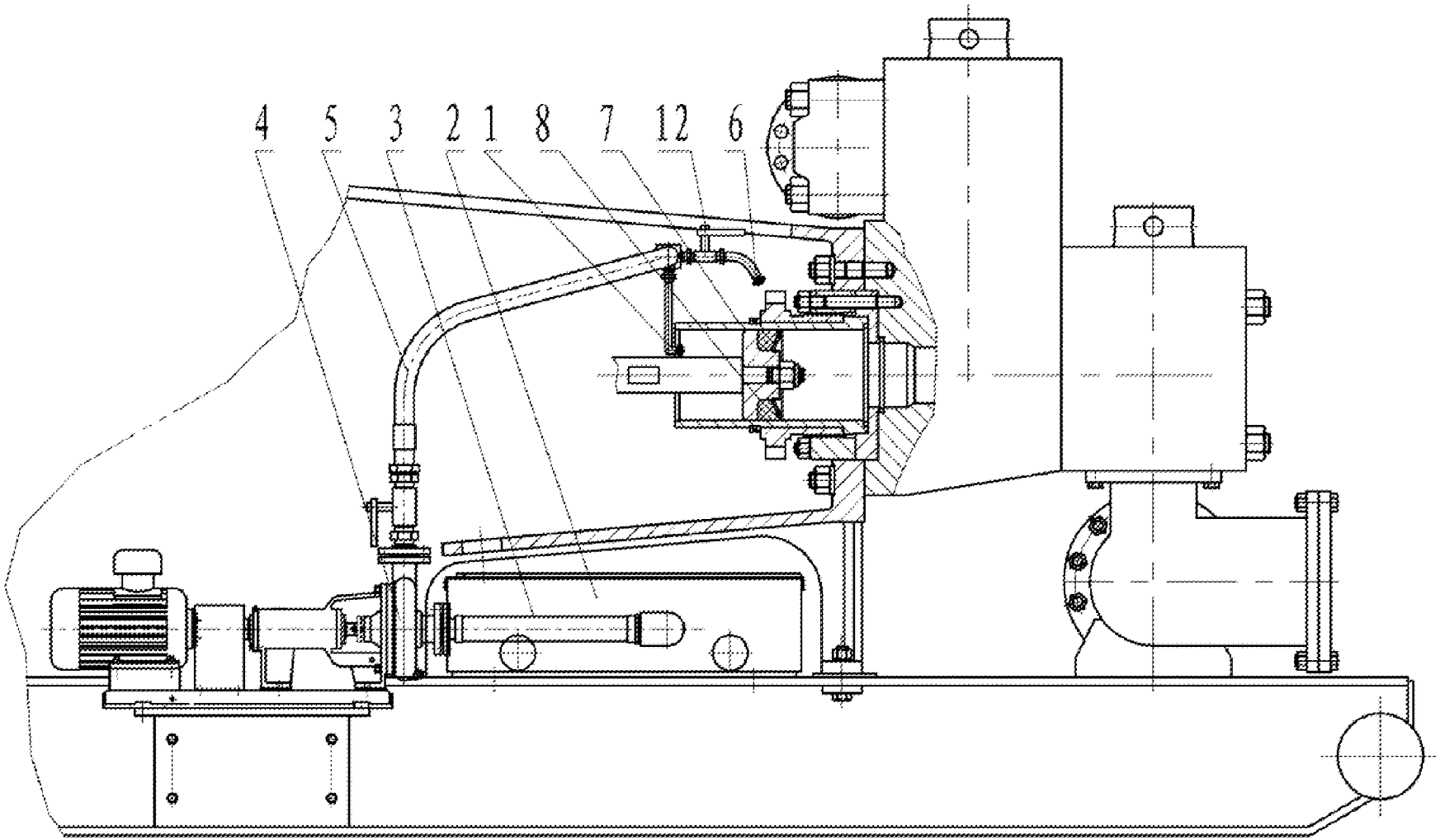
FIG. 1 is a schematic view of a structure according to a first embodiment of the present invention, wherein a cooling system for a liner/piston structure is shown.

In FIG. 1, a cooling device for interior and exterior surfaces of a mud pump liner includes a interior cooling nozzle 1, a water tank 2, a suction tube 3, a spray pump 4 and a discharge pipe 5, wherein the water tank 2 and the spray pump 4 are secured on the base of the mud pump, and the water tank 2 is placed below the liner 7. One end of the suction tube 3 is connected to the water tank 2, with the other end of the suction tube 3 connecting to the intake port of the spray pump 4. One end of the discharge pipe 5 is connected to the outlet port of the spray pump 4, with another end thereof connecting to the interior cooling nozzles 1 and the exterior cooling nozzle 6, via a three-way pipe, respectively. The interior cooling nozzle 1 is fixed at the left end of the liner 7, and its spray port is placed inside the liner 7. A valve 12 is serially connected between the exterior cooling nozzle 6 and the three-way pipe, and the spray port of the exterior cooling nozzle 6 is placed above the liner 7.

The operation principle of the system shown in FIG. 1 is as follows. When the piston 8 reciprocates in the liner 7, the cooling liquid in water tank 2 is sucked into the spray pump 4 through the suction tube 3, and is then transported to the interior cooling nozzle 1 and the exterior cooling nozzle 6 through the discharge pipe 5. The interior cooling nozzle 1 sprays against the interior surface of the liner 7 and cools it, while the exterior cooling nozzle 6 sprays against the exterior surface of the liner 7 and cools it. All the cooling liquid eventually flows back into the water tank 2 for circulation. In this way, heat generated by the reciprocating movement of the piston in the liner is carried away not only by the cooling liquid off the interior surface, but also by the cooling liquid off the exterior surface, which enables to simultaneously cool the interior and exterior surfaces of the liner. Thus the working temperature of the liner/piston can be significantly reduced, and the service life of the liner/piston is extended consequently. The valve 12 is used to adjust flow distribution of the cooling liquid.

Detailed description of the second embodiment is given below with reference to FIG. 2.

Figure 2:
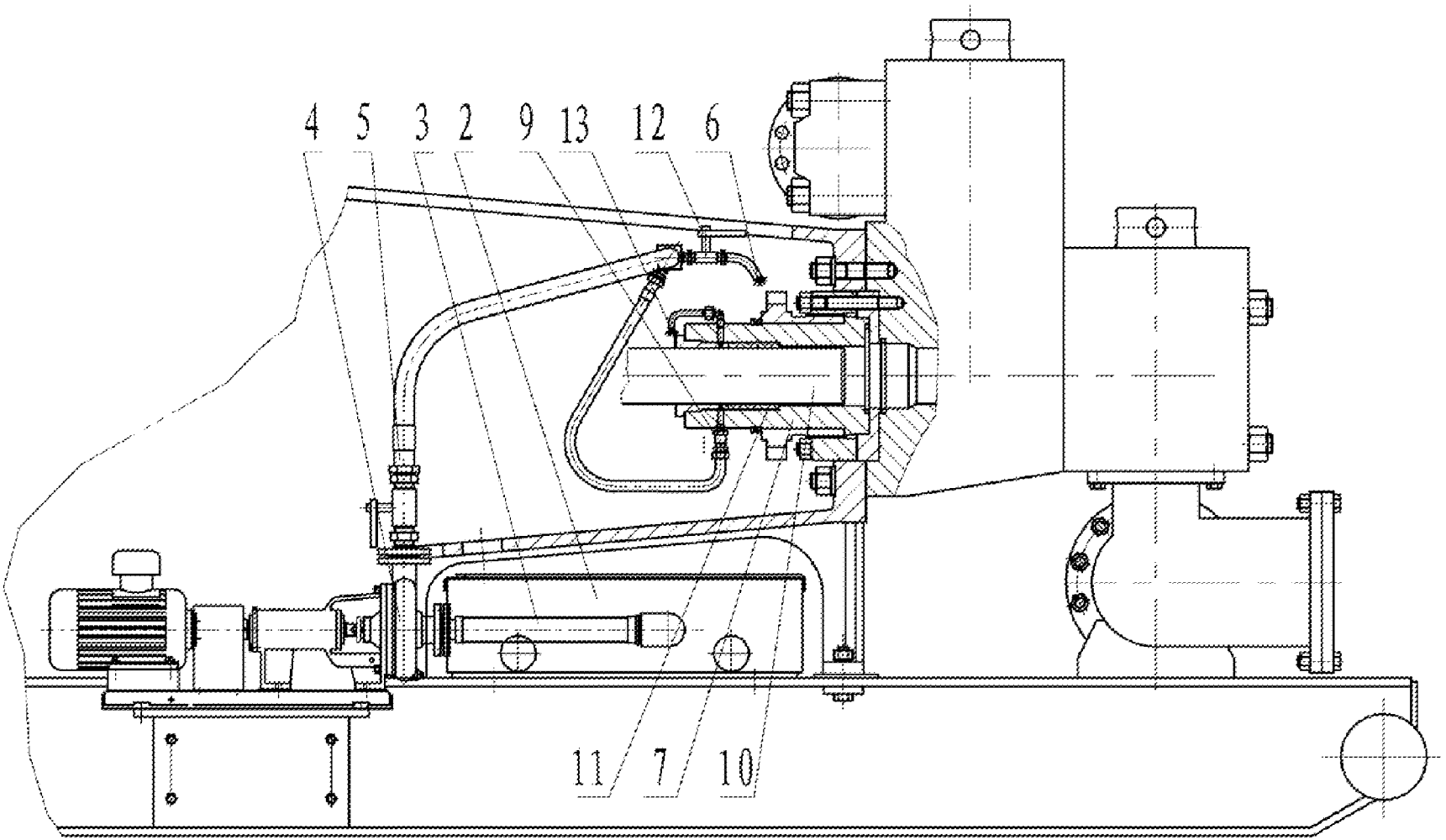
FIG. 2 is a schematic view of a structure according to a second embodiment of the present invention, wherein a cooling system for a liner/plunger structure is shown.

In FIG. 2 a cooling device for interior and exterior surfaces of a mud pump liner includes a plunger-cooling nozzle 13, a water tank 2, a suction tube 3, a spray pump 4, and a discharge pipe 5, where the water tank 2 and the spray pump 4 are secured on the base of the mud pump, and the water tank 2 is placed below the liner 7. One end of the suction tube 3 is connected to the water tank 2, and the other end of the suction tube 3 is connected to the intake port of the spray pump 4. An end of the discharge pipe 5 is connected to outlet port of the spray pump 4, and another end thereof is connected to the spray pipe 9 and the exterior cooling nozzle 6, respectively, via a three-way pipe. A valve 12 is serially connected between the exterior cooling nozzle 6 and the three-way pipe, and the spray port of the exterior cooling nozzle 6 is placed above the liner 7. An annular passage for cooling liquid is set between the plunger 10 and the liner 7. An inlet and an outlet for the cooling liquid are formed on the outer wall of the liner 7 at the lower portion and the upper portion, and the annular passage for cooling liquid is connected to both the inlet and the outlet for cooling liquid. The spray pipe 9 is connected to the inlet port for cooling liquid on the lower portion of the outer wall of the liner 7. The outlet port for cooling liquid on upper part of outer wall of the liner 7 is connected to the plunger-cooling nozzle 13, and the spray port of the plunger-cooling nozzle 13 is located above the plunger 10.

The operation principle of the cooling system in FIG. 1 is as follows. When the plunger 10 reciprocates in the liner 7, the cooling liquid in the water tank 2 is sucked into the spray pump 4 through the suction tube 3, and is then transported to the spray pipe 9 and the exterior cooling nozzle 6 through the discharge pipe 5. The exterior cooling nozzle 6 sprays against the outer surface of the liner and cools it. An annular passage for cooling liquid is set between the plunger 10 and liner 7, near packing 11. The cooling liquid which flows in through the spray pipe 9 washes and cools the plunger surface at the packing 11 inside the liner. The cooling liquid that flows out of the liner 7 further cools the exterior surface of the plunger 10 again via the plunger-cooling nozzle 13. All the cooling liquid eventually flows back into the water tank 2 for circulation. In this way, the heat generated by the reciprocating movement of the plunger in the liner is carried away not only by the cooling liquid off the interior surface of the liner and the exterior surface of the plunger, but also by the cooling liquid off the exterior surface of the liner, which enables to simultaneously cool the interior and exterior surfaces of the liner. Thus the working temperature of the plunger/packing can be significantly reduced, and the service life is extended consequently. The valve 12 is used to adjust flow distribution of the cooling liquid.

What is claimed is:

1. A cooling device for interior and exterior surfaces of a mud pump liner comprising: an interior cooling nozzle, a water tank, a suction tube, a spray pump, and a discharge pipe, wherein one end of the suction tube is connected to the water tank, with the other end of the suction tube connecting to an intake port of the spray pump, and an end of the discharge pipe connected to an outlet port of the spray pump, with another end of the discharge pipe connecting to the interior cooling nozzle, wherein, said another end of the discharge pipe is also connected with an exterior cooling nozzle, a spray port of the interior cooling nozzle is placed inside the liner, and a spray port of the exterior cooling nozzle is placed outside the liner;

wherein said another end of the discharge pipe is connected to the interior cooling nozzle and the exterior cooling nozzle via a three-way pipe respectively, and a valve is serially connected between the exterior cooling nozzle and the three-way pipe.

2. A cooling device for interior and exterior surfaces of a mud pump liner comprising: a plunger-cooling nozzle, a water tank, a suction tube, a spray pump, and a discharge pipe, wherein one end of the suction tube is connected to the water tank, with the other end of the suction tube connecting to an intake port of the spray pump, and an end of the discharge pipe is connected to an outlet port of the spray pump, with another end of the discharge pipe connecting to a spray pipe, wherein said another end of the discharge pipe is also connected with an exterior cooling nozzle, and a spray port of the exterior cooling nozzle is placed outside the liner, the spray pipe is connected to an inlet for cooling liquid of the liner, an outlet for cooling liquid of the liner is connected to the plunger-cooling nozzle, and a spray port of the plunger-cooling nozzle is placed outside a corresponding plunger to be cooled;

wherein said another end of the discharge pipe is respectively connected to the spray pipe and the exterior cooling nozzle via a three-way pipe, and a valve is serially connected between the exterior cooling nozzle and the three-way pipe.

* * * * *